US008382373B1

(12) United States Patent
Dancyger

(10) Patent No.: US 8,382,373 B1
(45) Date of Patent: Feb. 26, 2013

(54) WEAR-POINT PROTECTION SYSTEM, APPARATUS AND METHOD

(75) Inventor: Michael Dancyger, South Gate, CA (US)

(73) Assignee: Custom LeatherCraft Manufacturing Co., Inc., South Gate, CA (US)

( * ) Notice: Subject to any disclaimer, the term of this patent is extended or adjusted under 35 U.S.C. 154(b) by 575 days.

(21) Appl. No.: 12/384,396

(22) Filed: Apr. 4, 2009

(51) Int. Cl.
*B65D 30/10* (2006.01)
*B65D 33/02* (2006.01)
*A45C 13/36* (2006.01)

(52) U.S. Cl. ..... 383/121; 383/119; 190/37; 190/127

(58) Field of Classification Search ..... 383/121, 383/121.1, 119, 105; 190/37, 126, 127
See application file for complete search history.

(56) References Cited

U.S. PATENT DOCUMENTS

| | | | | | |
|---|---|---|---|---|---|
| 800,346 | A * | 9/1905 | White | 190/37 |
| 1,119,517 | A * | 12/1914 | Kaufmann | 190/125 |
| 1,211,165 | A * | 1/1917 | Kaufmann | 190/37 |
| 1,433,263 | A * | 10/1922 | Dresner | 190/37 |
| 1,967,160 | A * | 7/1934 | Piotkin | 190/127 |
| 2,266,181 | A * | 12/1941 | Epps | 206/544 |
| 2,847,100 | A * | 8/1958 | Hotchner | 206/504 |
| 3,578,115 | A * | 5/1971 | Schneider | 190/115 |
| 4,163,484 | A * | 8/1979 | Delaney | 190/18 R |
| D304,784 | S * | 11/1989 | De Witt | D3/274 |
| 5,111,920 | A * | 5/1992 | Castelli et al. | 190/120 |
| D333,566 | S * | 3/1993 | Landreau | D3/283 |
| 5,197,579 | A * | 3/1993 | Bieber et al. | 190/18 A |
| 5,794,747 | A * | 8/1998 | Bryant | 190/18 R |
| 6,279,707 | B1 * | 8/2001 | Godshaw et al. | 190/127 |
| 6,357,568 | B1 * | 3/2002 | Chen | 190/37 |
| D473,380 | S * | 4/2003 | Chen | D3/322 |
| 6,648,137 | B2 * | 11/2003 | Hamamori | 206/315.3 |
| D496,955 | S * | 10/2004 | Hayashi | D16/219 |
| D548,964 | S * | 8/2007 | Aliberti et al. | D3/283 |
| 7,503,440 | B2 * | 3/2009 | Gormick et al. | 190/102 |
| D608,096 | S * | 1/2010 | Noble | D3/318 |
| 7,810,998 | B2 * | 10/2010 | Williams | 383/16 |
| 2004/0149600 | A1 * | 8/2004 | Wolter et al. | 206/223 |
| 2007/0025647 | A1 * | 2/2007 | Hamlin | 383/14 |
| 2007/0241014 | A1 * | 10/2007 | Williams | 206/373 |
| 2007/0241113 | A1 * | 10/2007 | Williams | 220/500 |

FOREIGN PATENT DOCUMENTS

JP 06217816 A * 8/1994

* cited by examiner

*Primary Examiner* — Jes F Pascua

(57) ABSTRACT

The invention provides a wear protector device, system and method. The device including a first protective layer configured to cover a wear-point of a utility bag, and a reinforcement covering connected over a portion of the first layer. The reinforcement covering including a flat portion and a raised portion.

18 Claims, 5 Drawing Sheets

WEAR-POINT PROTECTION SYSTEM, APPARATUS AND METHOD

BACKGROUND

1. Field

The embodiments relate to utility bags, and in particular to an apparatus, method and system for wear-point protection on utility bags.

2. Description of the Related Art

Utility bags come in all shapes and sizes. Utility bags can be used for many different tasks, for example: tool bags, accessory bag, hobby bag, etc. These utility bags are used in many sites that can wear down portions of the bags. Usually the bags are normally treated roughly and are dropped or tossed to the ground. These bags also are placed in a bed of a truck and slide on the bottom portion of the bag. The rough treatment of the utility bags can cause a portion of the bag to wear down. This portion is on the bottom of the bag and causes the bag to have a shorter usable life-time.

FIG. 1 illustrates a typical utility bag 100 including a bottom portion 105. This utility bag is made of material such as canvas, polyester and nylon, synthetic leather, leather, suede, etc. The regular use of the utility bag 100 causes excessive wearing of portions 110 and 120. The wearing of portions 110 and 120 cut the useful life-time of utility bag 100 down and also reduces the attractiveness of the utility bag 100.

SUMMARY

One embodiment of the invention includes a wear protector device including a first protective layer configured to cover a wear-point of a utility bag, and a reinforcement covering connected over a portion of the first layer. The reinforcement covering including a flat portion and a raised portion.

Another embodiment of the invention is a system including a utility bag including a plurality of wear-point protectors. Each of the plurality of the wear-point protectors including: a first protective layer configured to cover a wear-point of a utility bag, and a reinforcement covering coupled over a portion of the first layer. The reinforcement covering including a flat portion and a raised portion.

Yet another embodiment of the invention includes method including tracking a plurality of utility bags during each of the utility bags useful life, determining at least one wear-point on each of the plurality of utility bags, and applying a first wear-protector on a plurality of new utility bags. The first wear-protector being applied over the at least one determined wear-point. The first wear-protector is configured to extend the useful life of the plurality of new utility bags over the useful life of the plurality of utility bags.

Other aspects and advantages of the present invention will become apparent from the following detailed description, which, when taken in conjunction with the drawings, illustrate by way of example the principles of the invention.

BRIEF DESCRIPTION OF THE DRAWINGS

The embodiments are illustrated by way of example, and not by way of limitation, in the Figures of the accompanying drawings and in which like reference numerals refer to similar elements and in which.

DETAILED DESCRIPTION

The following description is made for the purpose of illustrating the general principles of the invention and is not meant to limit the inventive concepts claimed herein. Further, particular features described herein can be used in combination with other described features in each of the various possible combinations and permutations. Unless otherwise specifically defined herein, all terms are to be given their broadest possible interpretation including meanings implied from the specification as well as meanings understood by those skilled in the art and/or as defined in dictionaries, treatises, etc.

The description may disclose several preferred embodiments of wear protectors, as well as operation and/or component parts thereof. While the following description will be described in terms of wear protectors and devices for clarity and to place the invention in context, it should be kept in mind that the teachings herein may have broad application to all types of systems, devices and applications.

One embodiment of the invention provides a wear protector apparatus, system and method. The device including a first protective layer configured to cover a wear-point of a utility bag, and a reinforcement covering connected over a portion of the first layer. The reinforcement covering including a flat portion and a raised portion.

Figure 1:
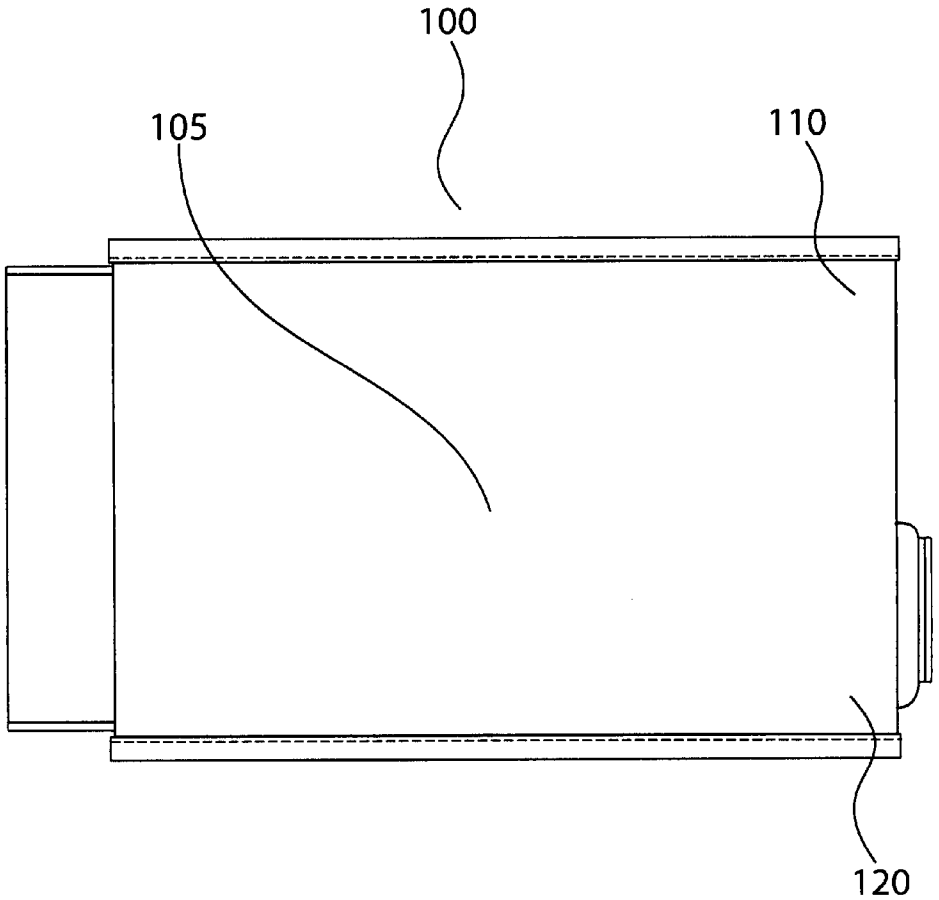
Fig. 1 (Prior Art)
FIG. 1 illustrates a bottom portion of a prior art utility bag.
Figure 2:
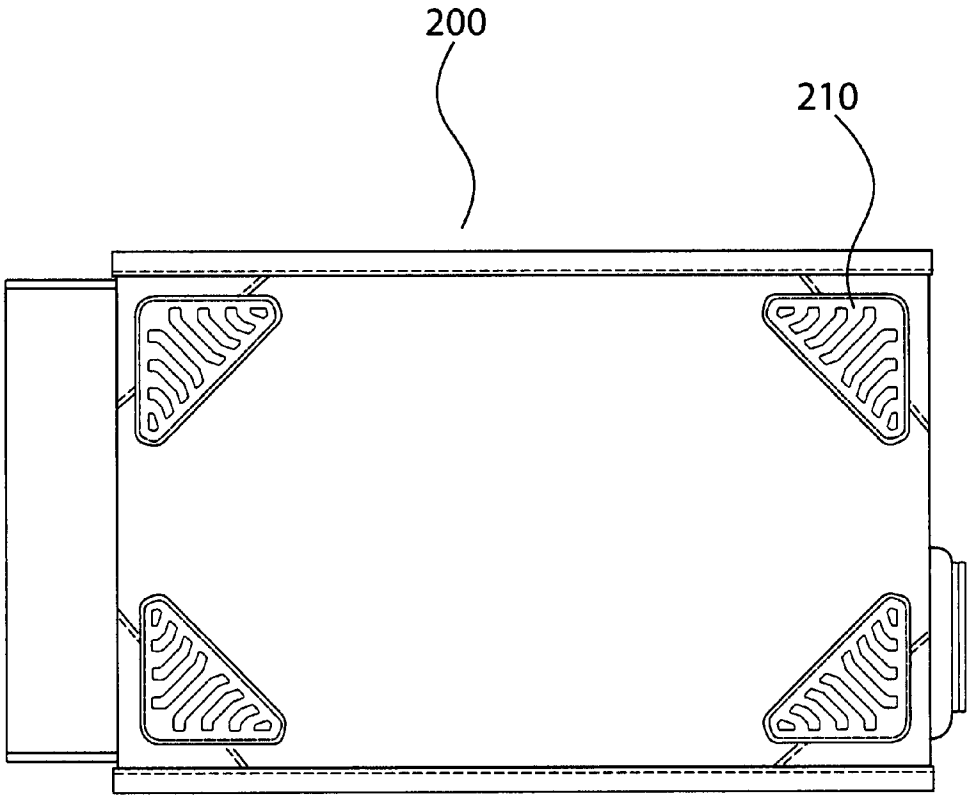
FIG. 2 illustrates a bottom view of a utility bag including wear-point protection according to one embodiment of the invention.

FIG. 2 illustrates a bottom view of a utility bag 200 including wear protectors 210 according to one embodiment of the invention. In this embodiment of the invention, the wear protectors 210 are positioned over a wear-point of the utility bag 200. In one embodiment of the invention the wear protectors 210 are shaped triangularly. In other embodiment of the invention, the wear protectors 210 have different shapes, such as square, rectangular, polygonal, circular, elliptical, etc.

In one embodiment of the invention the wear protectors 210 are made of a heavy duty material, such as rubber, hardened plastic, a composite material, a fiber material, a polymer material, etc.

In one embodiment of the invention, the utility bag 200 can be a tool bag, accessory bag, gym bag, a bowling ball bag, etc. In one embodiment of the invention, it is determined wear one or more wear-points exist on a utility bag. In this embodiment, the determination of where the wear-point exists on the utility bag is made by tracking the use of the utility bag and by testing. Multiple utility bags are used daily and the wear of the utility bags are tracked to determine exactly where on the utility bag wear-points exist. Testing is done by loading the utility bag in different ways and determining the point or points on the utility bag that make the most contact with a surface. A wear point is then applied to the determined wear-point(s) and tracking can be repeated to determine whether the wear-protector(s) are successful in adding more protection to the utility bag.

In one embodiment of the invention, the wear-protector 210 is applied over the wear-point and attached to a utility bag by sewing the wear-protector 210 to the utility bag 200 using thread (see FIG. 3, 340), adhesive, rivets, screws, etc. In one embodiment of the invention, the wear-protectors 210 are permanently attached to a utility bag 200. In another embodiment the wear protectors 210 are replaceable. In this embodiment of the invention, the wear protectors 210 are connected to the utility bag by screws, bolts, sockets, etc. In another embodiment of the invention, the wear protectors 210 include a groove that is configured to fit a rail or track that is attached to the utility bag 200. In this embodiment, the wear protector 210 slides onto the rail or track and locks in place with known locking/releasing means. In other embodiments, different know removable means for coupling the wear protectors are used. By having replaceable wear protectors 210, as the wear protector 210 wears down, replacement of the wear protector 210 extends the useful life span of the utility bag 200.

In another embodiment of the invention, the wear protectors 210 can be repositioned to protect a wear point that may not have been protected by the original placement of the wear protector 210. In this embodiment of the invention, the repositioning of the wear protector 210 is accomplished by drilling new holes and filling the old holes, screwing, bolting, riveting, re-sewing, etc. In another embodiment of the invention, an additional wear protector (not shown) can be added if more wear protection is necessary on the utility bag 200.

Figure 3:
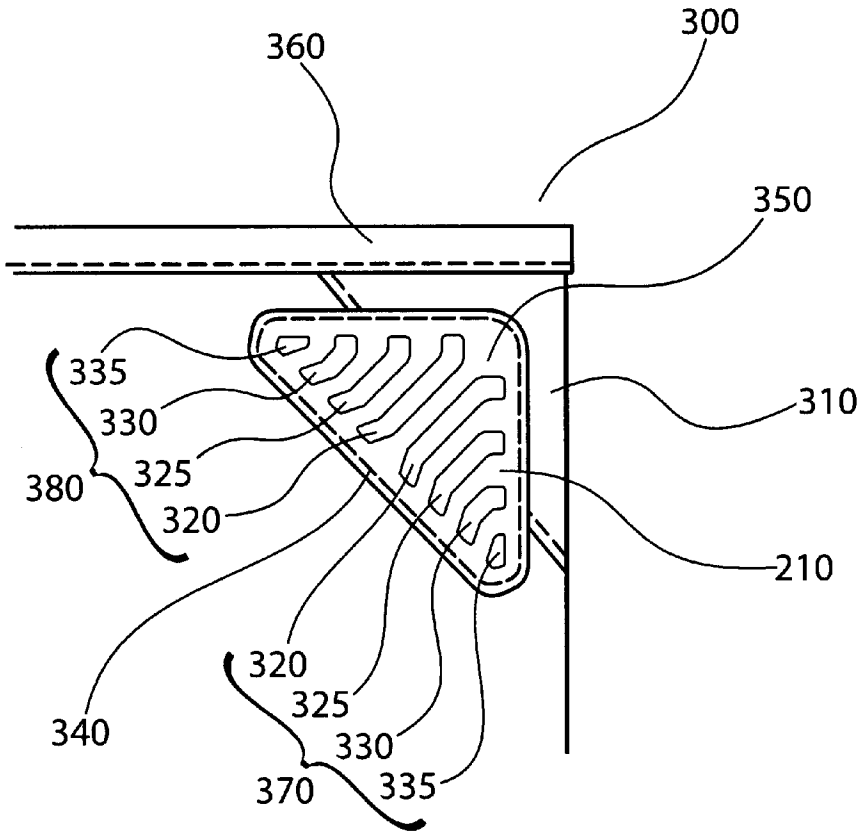
FIG. 3 illustrates a close-up view of a bottom portion of a wear-point protective system according to one embodiment of the invention.

FIG. 3 illustrates an isolated view of a wear protector 210 attached to a first protective layer 310 of a utility bag 300 according to one embodiment. It should be noted that other embodiments of the invention include more protective layers (e.g., two, three, etc.) and can include multiple layers of wear protectors. In one embodiment of the invention, a first protective layer 310 is positioned at a corner of the utility bag 300 and also positioned over a wear point or a portion of the wear point. In one embodiment of the invention, the first protective layer 310 is made of a heavy duty material, such as canvas, polyester and nylon, synthetic leather, leather, suede, etc. In one embodiment of the invention the first protective layer 310 is attached to the utility bag 300 by sewing with heavy duty thread, such as polyester and nylon, nylon, etc.

In one embodiment of the invention a second protective layer 360 is positioned over an edge of the first protective layer. In one embodiment of the invention the first protective layer 310 is triangular shaped to fit in the corner of the bottom of the utility bag 300. In one embodiment of the invention the first protective layer has one side folded in to a bottom edge of the utility bag 300. In one embodiment of the invention the second protective layer covers the bottom edge of the utility bag 300 for protection against wear of the bottom edge at the corner of the bottom of the utility bag 300.

In one embodiment of the invention the wear protector 210 has a flat portion 350. In another embodiment of the invention the wear protector 210 has a plurality of ridges (320, 325, 330, and 335). In one embodiment of the invention the plurality of ridges include two sets of ridges 370 and 380. In this embodiment of the invention each set 370 and 380 include ridges 320, 325, 330 and 335. It should be noted that other embodiments of the invention can include more or less ridges.

In one embodiment of the invention the length of the ridges are different. For example, in one embodiment of the invention, ridge 320 has a greater length than ridge 325, which has a greater length than ridge 330, which has a greater length than ridge 335. In other embodiments of the invention, the ridges 320, 325, 330- and 335 can have longer or shorter lengths in any order.

In one embodiment of the invention the ridges 320, 325 and 330 have a same width. In one embodiment of the invention the ridge 335 has a less of a width than ridges 320, 325 and 330. In other embodiments the ridges 320, 325, 330 and 335 can have varying widths, wider widths, narrower widths, etc.

In one embodiment of the invention, the ridges 320, 325, 330 and 335 have a same height that distances the utility bag 300 from a surface (e.g., the ground, a table, a floor, etc.) based on the height of the ridges 320, 325, 330 and 335. In one embodiment of the invention the ridges 320, 325, 330 and 335 have different heights. In one embodiment of the invention ridge 320 has a greater height than ridge 325, which has a greater height than ridge 330, which has a greater height than ridge 335. In other embodiments of the invention the ridges 320, 325, 330 and 335 can have differing heights based on the shape of the utility bag 300 in order to maintain contact with a surface and prevent wearing of the utility bag 300.

Figure 4:
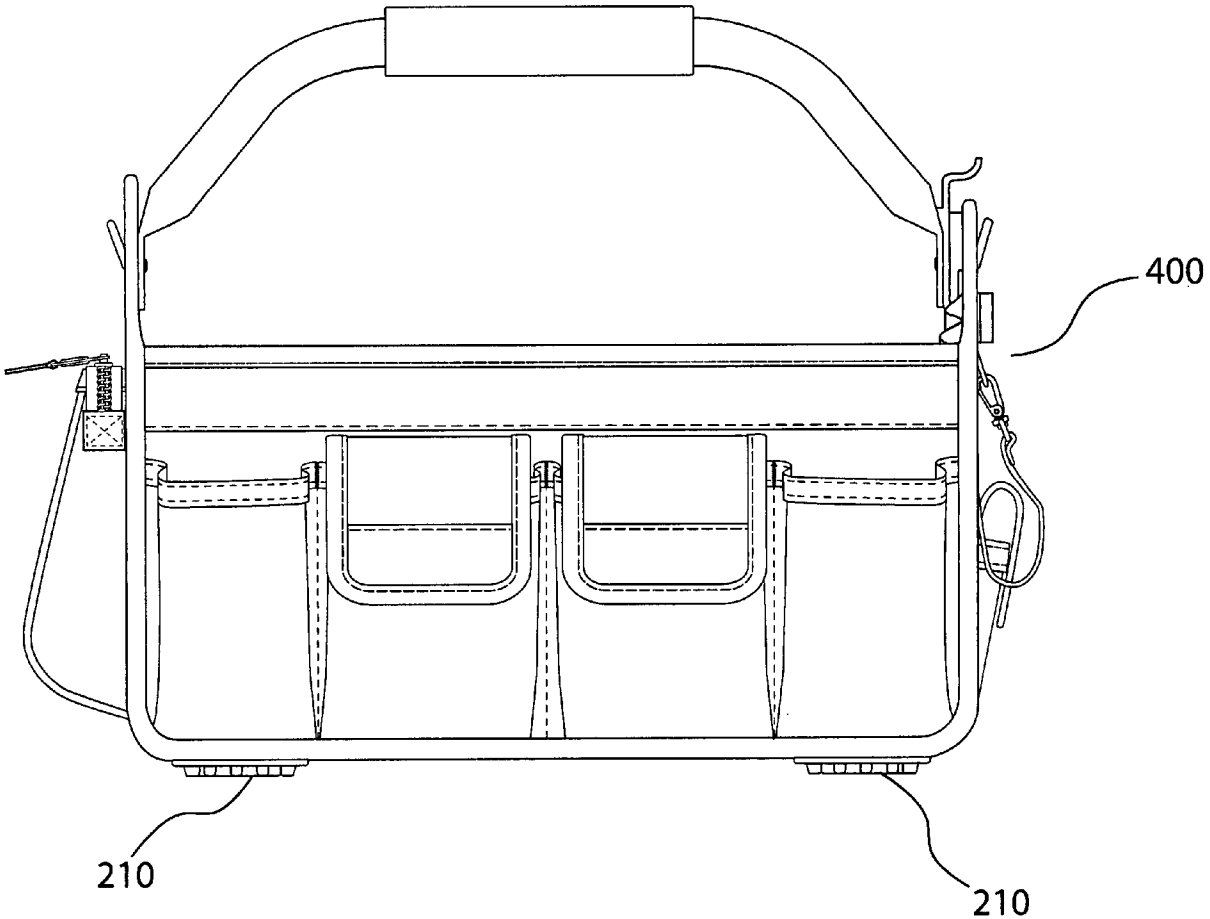
FIG. 4 illustrates a front view of a utility bag including wear-point protection according to one embodiment of the invention.

FIG. 4 illustrates a front view of a utility bag 400 including wear protectors 210.

Figure 5:
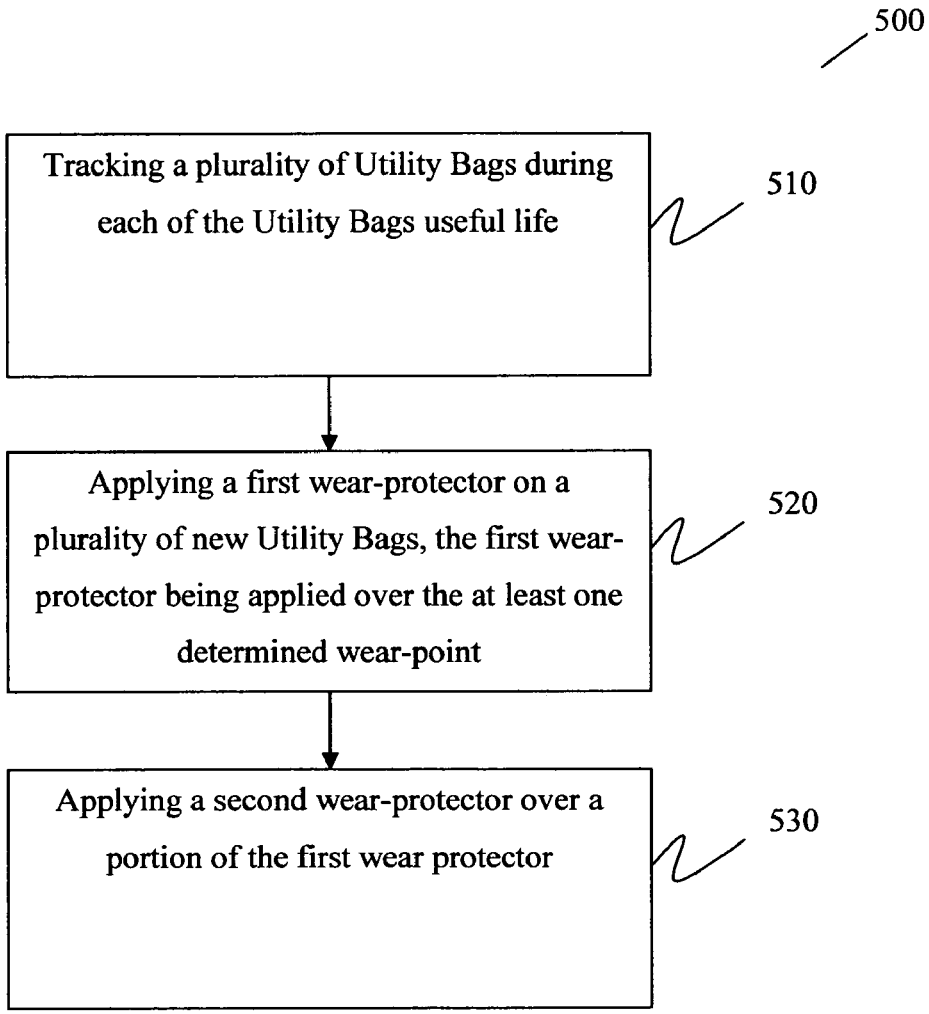
FIG. 5 illustrates a block diagram of a process for determining a wear point of a utility bag and applying wear protection.

FIG. 5 illustrates a block diagram of a method 500 for determining a wear point of a utility bag (e.g., utility bag 200, 300, 400) and applying wear protection according to one embodiment of the invention. Block 510 includes tracking a plurality of utility bags during each of the utility bags useful life. In one embodiment of the invention, the tracking is made by known tracking techniques, such as communicating with owners/users of the utility bags, surveys, interviews, testing, etc. In block 520 a first wear-protector (e.g., wear protector 210 or 310) is applied on a plurality of new utility bags. The first wear-protector being applied over the at least one determined wear-point. The first wear-protector is configured to extend the useful life of the plurality of new utility bags over the useful life of the utility bags. In one embodiment of the invention, block 530 includes applying a second wear-protector over a portion of the first wear protector for reinforced protection.

With the use of determining where the wear points are on utility bags, wear protectors can be designed, shaped and attached to extend the useful life of utility bags, thus saving replacement costs. By continuously determining where al wear points may occur, an optimum placement and sizing of wear protectors can be achieved.

In the description above, numerous specific details are set forth. However, it is understood that embodiments of the invention may be practiced without these specific details. For example, well-known equivalent components and elements may be substituted in place of those described herein, and similarly, well-known equivalent techniques may be substituted in place of the particular techniques disclosed. In other instances, well-known structures and techniques have not been shown in detail to avoid obscuring the understanding of this description.

Reference in the specification to "an embodiment," "one embodiment," "some embodiments," or "other embodiments" means that a particular feature, structure, or characteristic described in connection with the embodiments is included in at least some embodiments, but not necessarily all embodiments. The various appearances of "an embodiment," "one embodiment," or "some embodiments" are not necessarily all referring to the same embodiments. If the specification states a component, feature, structure, or characteristic "may", "might", or "could" be included, that particular component, feature, structure, or characteristic is not required to be included. If the specification or claim refers to "a" or "an" element, that does not mean there is only one of the element. If the specification or claims refer to "an additional" element, that does not preclude there being more than one of the additional element.

While certain exemplary embodiments have been described and shown in the accompanying drawings, it is to be understood that such embodiments are merely illustrative of and not restrictive on the broad invention, and that this invention not be limited to the specific constructions and arrangements shown and described, since various other modifications may occur to those ordinarily skilled in the art.

What is claimed is:

1. A wear protector comprising:

a first protective layer that covers a wear-point of a corner of a four-sided utility bag; and a reinforcement covering coupled over a portion of the first layer, the reinforcement covering including a flat portion and a raised portion, wherein the raised portion includes at least two pairs of ridges, wherein each ridge in a pair of ridges has a same length, and each pair having different lengths from one another.

2. The wear protector of claim 1, further comprising a second protective layer coupled over an edge of the first protective layer.

3. The wear protector of claim 1, wherein the raised portion including a plurality of ridges.

4. The wear protector of claim 3, wherein the plurality of ridges have a same height.

5. The wear protector of claim 1, wherein each ridge of each pair of ridges are spaced a part from each other.

6. The wear protector of claim 1, wherein the first protective layer and the reinforcement covering have a similar shape.

7. The wear protector of claim 1, wherein the reinforcement covering is removably coupled to the first protective layer.

8. The wear protector of claim 1, wherein the first protective layer is made of a different material than the reinforcement covering.

9. The wear protector of claim 1, wherein the reinforcement covering has a triangular shape.

10. A system comprising:

a four-sided utility bag including a plurality of wear-point protectors;

each of the plurality of wear-point protectors including:

a first protective layer covering a wear-point of a corner of the utility bag; and a reinforcement covering coupled over a portion of the first layer, the reinforcement covering including a flat portion and a raised portion, wherein the raised portion includes at least two pairs of ridges, wherein each ridge in a pair of ridges has a same length, and each pair having different lengths from one another.

11. The system of claim 10, further comprising a second protective layer coupled over an edge of the first protective layer.

12. The system of claim 10, wherein the reinforcement covering has a triangular shape.

13. The system of claim 12, wherein the plurality of ridges have a same height.

14. The system of claim 12, wherein the reinforcement covering is offset from the corner of the utility bag.

15. The system of claim 12, wherein the first set of ridges each have a same height, and the second set of ridges each have a same height.

16. The system of claim 10, wherein each of the plurality of reinforcement coverings is removably coupled to the first protective layer.

17. A method comprising:

determining at least one wear-point on a four-sided utility bag;

applying a first wear-protector on a corner of the utility bag, the first wear-protector being applied over the at least one determined wear-point; and applying a second wear-protector including at least two pairs of raised ridges over a portion of the first wear protector, wherein each ridge in a pair of ridges has a same length, and each pair of ridges have different lengths from one another, wherein the first wear-protector and the second wear-protector extend the useful life of the utility bag over the useful life of the utility bag.

18. The method of claim 17, wherein determining at least one wear-point on a utility bag comprises tracking a plurality of utility bags during each of the utility bags useful life.

* * * * *